United States Patent [19]

Kunig et al.

[11] 4,074,394

[45] Feb. 21, 1978

[54] APPARATUS FOR DEPOSITING A SLIVER IN A SLIVER CAN

[75] Inventors: Helmut Kunig; Klaus Reinke, both of Hamburg, Germany

[73] Assignee: Hanseatischer Maschinenbau G.m.b.H., Hamburg, Germany

[21] Appl. No.: 505,233

[22] Filed: Sept. 12, 1974

[30] Foreign Application Priority Data

Oct. 24, 1973 Germany ..... 2353889

[51] Int. Cl.[2] ..... B65H 54/80

[52] U.S. Cl. ..... 19/159 R

[58] Field of Search ..... 19/159 R, 159 A, 157, 19/260; 28/21; 242/82, 83

[56] References Cited

U.S. PATENT DOCUMENTS

| | | | |
|---|---|---|---|
| 3,681,815 | 8/1972 | Gunter et al. | 19/159 R |
| 3,728,760 | 4/1973 | Johns | 19/159 R |
| 3,858,278 | 1/1975 | Schmitt et al. | 19/260 |

FOREIGN PATENT DOCUMENTS

| | | | |
|---|---|---|---|
| 1,075,831 | 4/1954 | France | 19/159 R |
| 377,363 | 7/1962 | Japan | 19/159 R |
| 10,117 of | 1844 | United Kingdom | 19/159 R |

*Primary Examiner*—Dorsey Newton
*Attorney, Agent, or Firm*—Edward F. Levy

[57] ABSTRACT

Apparatus for depositing a sliver of wool into a sliver can with a coiler plate rotated with high circumferential speed. The coiler plate has a pair of calender cylinders excentrically arranged in it and a nozzle for the central inlet of the slivers. One single wire race ball bearing carries the coiler plate and is surrounded by a tooth belt pulley fixed to the latter, thus enabling the tooth belt to run in the plane of rotation of the wire race of the ball bearing. A guiding device for the sliver is arranged at the top of the coiler plate between the nozzle and the nip of the calender cylinders and comprises a pipe socket affixed to the coiler plate and a sliding pipe telescopically slidable along the free end of the pipe socket and being beveled at its lower end.

2 Claims, 2 Drawing Figures

APPARATUS FOR DEPOSITING A SLIVER IN A SLIVER CAN

BACKGROUND OF THE INVENTION

1. Field of Invention

The invention relates to an apparatus for depositing a sliver of wool into a sliver can including a coiler plate pivoted upon a vertical axis by means of a bearing held in a bearing ring, carrying the rim of a bevel ring gear on its top side, the coiler plate being provided with a tooth belt pulley and a pair of counteracting calender cylinders, one of which is coupled with a pinion meshing with the rim of the bevel ring gear, and a guiding device for the roving sliver arranged in front of the calender cylinders and comprising a nozzle arranged concentrically to its axis of rotation.

2. Description of Prior Art

In French Pat. No. 1 075 831 an apparatus for depositing a sliver in a sliver can is disclosed, in which a coiler plate is pivoted upon a vertical axis by means of a sliding bearing near its bottom. A rim of a bevel ring gear surrounds the sliding bearing. The coiler plate has a tooth belt pulley, fixed to it above the sliding bearing, and a pair of counteracting calender cylinders, one of which is coupled to a pinion meshing with the rim of the bevel ring gear. One nozzle is fixed to the coiler plate above the nip of the calender cylinders. Another nozzle arranged concentrically to the axis of rotation of the coiler plate above the latter is fixed to a cover enveloping the whole apparatus. This apparatus suffers from the disadvantages that the circumferential speed of the coiler plate is limited in spite of the use of a sliding bearing and the deviation of the running planes of the sliding bearing and the tooth belt, that the sliver is not guided between the two nozzles, and that it is difficult to feed the porter of a roving sliver into the nip of the calender cylinders. Furthermore the unclean shape of the coiler plate produces a high aerodynamic drag when rotating within its cover followed by considerable noise.

3. Object of the Invention

It is the main object of the invention to overcome the disadvantages of the known apparatus and provide an apparatus for depositing a sliver into a sliver can free of vibrations and of low noise, with a cleanly shaped coiler plate of low aerodynamic drag, with positive control of the roving sliver between the nozzle and the tip of the calender cylinders, and the possibility of easily feeding the porter of a sliver between the calender cylinders. A further object is to achieve delivery speeds for slivers of wool up to 400 meters per minute.

SUMMARY OF THE INVENTION

In the apparatus for depositing a sliver of wool into a sliver can said bearing of the coiler plate is formed by a wire race ball bearing; said tooth belt pulley surrounds said bearing ring incorporating said wire race ball bearing; said tooth belt rotating said coiler plate runs in or close to the plane of rotation of said wire race ball bearing; and said guiding device for the slivers includes a nozzle and a pipe socket, both affixed to the top of said coiler plate by means of a nozzle holder, and a sliding pipe, said pipe socket being inclined to said coiler plate and directed to the nip of said counteracting calender cylinders and said sliding pipe being slidable on the free end of said pipe socket and beveled at its lower end, thus fitting tighly to said coiler cover.

According to a preferred embodiment of the invention the coiler plate is a closed flat and disk-like shaped rotational body, its top bearing a closed guiding device for a supplied sliver, while said body is enclosed at its outer periphery by a cowling furnished with a hose coupling for fitting to a suction pipe, the coiler plate including a lower cylinder formed by a raceway, an upper cylinder formed by an outer wall and a flat cover with a nozzle holder on its top and having a first opening for said sliver above the nip of said calender cylinders, a second opening below the latter for the delivering of the slivers, and a third opening for said projecting pinion.

DESCRIPTION OF A PREFERRED EMBODIMENT

Figure 1:
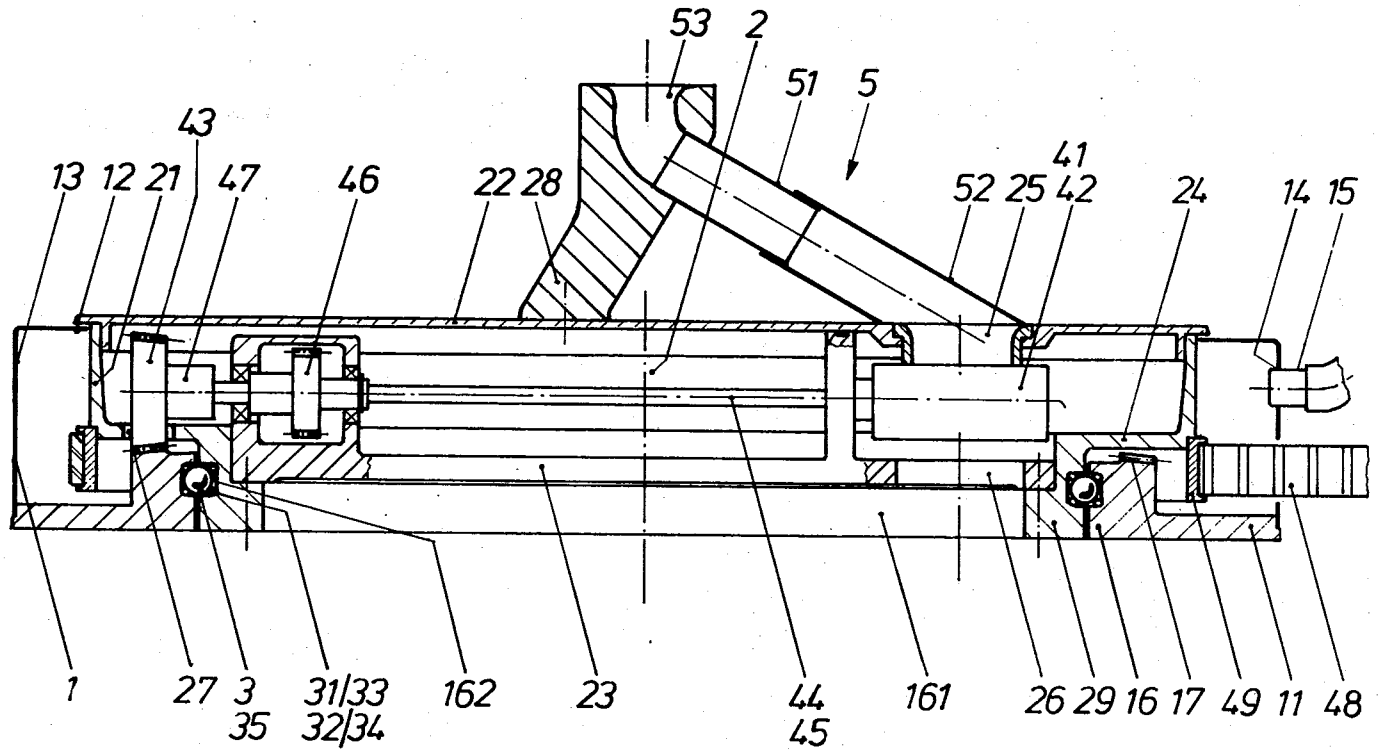
FIG. 1 is a cross sectional side elevation of an apparatus according to the invention and FIG. 2 is a partially broken top view of said apparatus.
Figure 2:
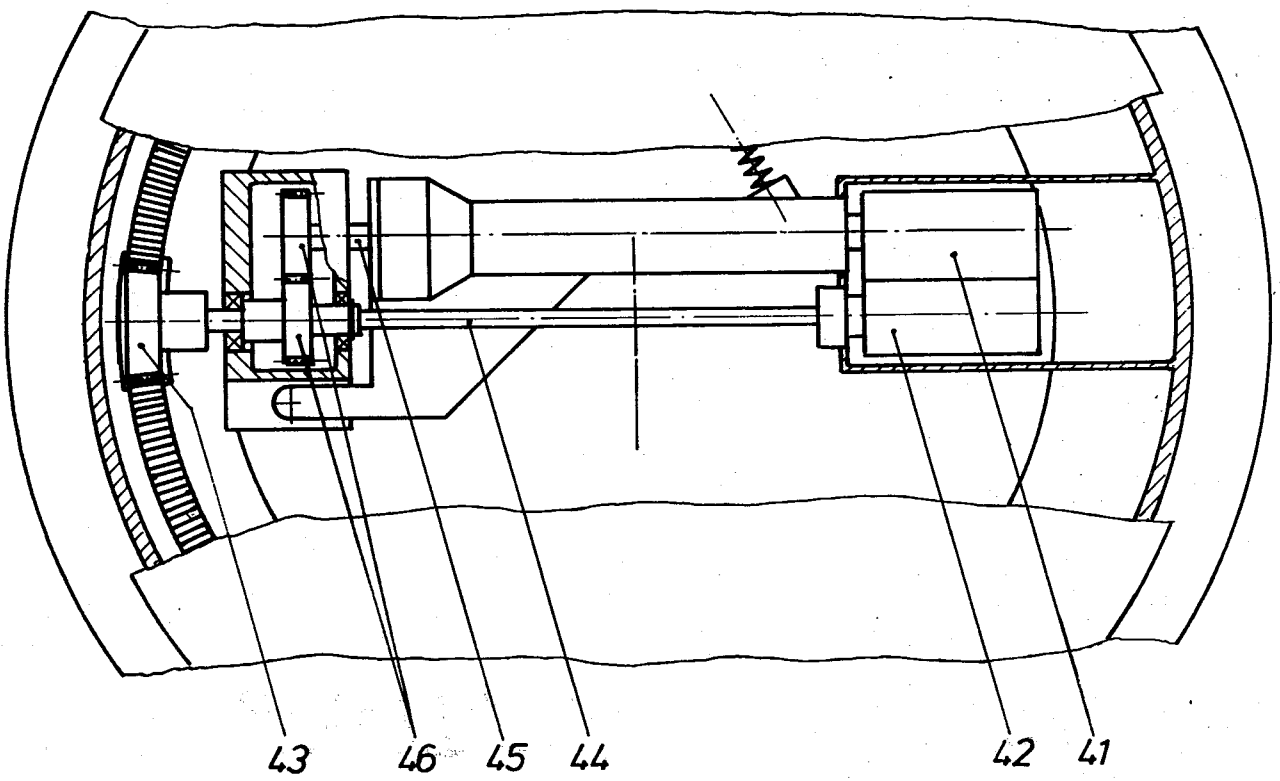

In a drawing machine of the intersecting type for slivers one part of the machine frame, not shown in the drawings, extends over the path of the sliver cans to be filled. A bearing flange, ring, or socket 16 is fixed onto the top of the extension of the machine frame. The bearing flange 16 is of annular type and has an annular groove in its aperture 161 furnished with two wire rings 31, 32 held in fixed position by means of tension. A rim 17 of a bevel ring gear is provided on the top side of bearing flange 16. The cylindrical part of the bearing flange 16 is surrounded by a flat flange forming a base plate 11 which is fixed, e.g. bolted to the extension of the machine frame. By means of a wire race ball bearing 3 a coiler plate 2 is carried freely rotational within the bearing flange 16. The coiler plate 2 consists of a raceway 29, an intermediate plate or tray 24 extending outwardly from the top of the raceway, and a cylindrical outer wall 21 surrounding the latter. The raceway 29 has an annular groove 162 in its lateral area in which two further wire rings 33, 34 are held in fixed position by means of tension, forming part of the wire race ball bearing 3. The balls of the wire race ball bearing 3 are held at equal distance from each other by means of a retainer ring 35 made of plastic or aluminium alloy in any suitable manner. In order to rotate the coiler plate 2 with high speed, a tooth belt pulley 49 is fixed to the lower edge of the outer wall 21 so that a bellshaped configuration is achieved which surrounds the wire race ball bearing 3. The coiler plate 2 is locked from above by a coiler cover 22 and protected at its circumference by means of a cowling 1 consisting of a cylindrical cowl skirt 13 and a flat flange of the cowling shoulder 12, the cowling 1 having a bore 14 with a hose coupling 15 in it to which a suction pipe is fitted.

The coiler plate 2 contains a pair of calender cylinders 41, 42 rotated in opposite directions. A bottom plate 23 fixed within the coiler plate 2 has a pillow block with two ball bearings for a driving shaft 44 connected to calender cylinder 42 and another set of ball bearings for a driving shaft 45 engaging the other calender cylinder 41 by means of a universal joint propeller shaft. Bottom plate 23 is equipped with another ball bearing for driving shaft 44 adjacent to calender cylinder 42 and a pressure spring engaging a swinging arm containing the universal joint propeller shaft for rotating calender cylinder 41. Driving shaft 44 has a pinion 43 fixed to its free end. This pinion 43 is meshing with the rim of bevel ring gear 17 and is equipped with a spur gear 46, too, situated in the pillow block. Pinion 43 is coupled with driving shaft 44 by means of a safety clutch 47. The spur gear 46 of driving shaft 44 is meshing with second spur gear 46 mounted on the free end of driving shaft 45.

The bottom plate 23 has an opening 26 for delivering a sliver. The coiler cover 22 comprises a second opening 25 for the inlet of the roving sliver this second opening 25 being furnished with a guide for the sliver. To the top of coiler cover 22 there is fixed a nozzle holder 28 containing a nozzle 53 at its upper end. This nozzle 53 forms an inlet concentric to the axis of rotation of the coiler plate 2 and an outlet inclined in direction of the second opening 25. A pipe socket 51 is fixed to the outlet of nozzle 53 and is fitted with a sliding pipe 52, having a chamfering at its lower end and being slidable along the outside of pipe socket 51.

In operation of the aforedescribed apparatus the sliding pipe 52 is lifted by sliding it along the pipe socket 51. The free end of a sliver delivered from a drawing machine is fed into the nozzle 53 from above and proceeded through the pipe socket 51 and the sliding pipe 52 in any suitable manner, e.g. by means of suction, and led into the nip of the calender cylinders 41, 42. When the sliding pipe 52 has been returned into its lower position coiler plate 2 may be rotated by means of a tooth belt 48 engaging the tooth belt pulley 49 and driven by a wheel supported by the shaft of an electromotor or in any other suitable manner. If the coiler plate 2 is rotated clockwise - when seen from above - the pinion 43 meshing with the rim 17 of the bevel ring gear is rotated at high speed, thus giving high circumferential speed to the calender cylinders 41, 42, which are positioned excentrically to the axis of rotation of the coiler plate 2. The opening 26 below the calender cylinders moves along a circular path. Then a sliver fed to the calender cylinders 41 and 42 will be deposited in a sliver can in known manner.

What we claim as our invention and desire to secure by Letters Patent is:

1. Apparatus for depositing a sliver into a sliver can, comprising a support having an upwardly directed surface provided with a first annulus of gear teeth;

an anti-friction bearing mounted on said support for rotation in a substantially horizontal plane;

a coiler plate journalled in said bearing for rotation about an upright axis, said coiler plate having a circumferential rim which carries a second annulus of gear teeth located substantially in said plane, and also being provided with a sliver discharge opening eccentric to said axis;

a pair of cooperating feed rollers mounted above said opening for rotation with said coiler plate, said feed rollers defining with one another a nip above said discharge opening;

guide means for guiding a sliver to said nip from above said feed rollers, said guide means comprising a holder on said coiler plate rotatable therewith and having a nozzle coaxial with said axis of rotation, a tubular socket inclined to said axis and extending from said nozzle towards said nip, and a tubular member slidably telescoped onto said socket and movable to an extended position in which a free end of said tubular member is located above said nip, and a retracted position in which said free end is retracted laterally and upwardly of said nip so as to afford access thereto;

and drive means for said feed rollers, including a rotatable gear coaxial with said first annulus, and a toothed drive belt located substantially in said plane and surrounding said second annulus so that, when motion is imparted to said belt, the belt rotates said coiler plate substantially without vibration due to the location of said belt relative to said plane.

2. An apparatus as defined in claim 1; further comprising a cover mounted on and rotatable with said coiler plate, said cover having an opening above said feed rollers; and wherein said free end of said tubular member is formed with a bevel which snugly fits against said cover about said opening when said tubular member is in said first position thereof.

* * * * *